US008240657B2

(12) United States Patent
Tanaka et al.

(10) Patent No.: US 8,240,657 B2
(45) Date of Patent: Aug. 14, 2012

(54) SHEET FEEDING DEVICE AND IMAGE FORMING APPARATUS

(75) Inventors: Mizuna Tanaka, Osaka (JP); Hiroshi Fujiwara, Osaka (JP); Yasuo Matsuyama, Hyogo (JP); Kazuyoshi Kondo, Osaka (JP); Toshikane Nishii, Osaka (JP); Ippei Kimura, Osaka (JP); Tomoyoshi Yamazaki, Ibaraki (JP); Haruyuki Honda, Ibaraki (JP); Yasuhide Ohkubo, Osaka (JP); Masafumi Takahira, Ibaraki (JP); Ikuo Fujii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 264 days.

(21) Appl. No.: 12/289,251

(22) Filed: Oct. 23, 2008

(65) Prior Publication Data

US 2009/0121418 A1 May 14, 2009

(30) Foreign Application Priority Data

Nov. 8, 2007 (JP) ..... 2007-290674
Feb. 1, 2008 (JP) ..... 2008-022726
Apr. 23, 2008 (JP) ..... 2008-112465

(51) Int. Cl.
*B65H 3/52* (2006.01)

(52) U.S. Cl. ..... 271/121; 271/109; 271/120

(58) Field of Classification Search ..... 271/109, 271/120, 121

See application file for complete search history.

(56) References Cited

U.S. PATENT DOCUMENTS 5,004,217 A * 4/1991 Kano et al. ..... 271/10.11
5,104,113 A * 4/1992 Kameyama et al. ..... 271/124
5,727,782 A * 3/1998 Okada ..... 271/121
6,082,726 A * 7/2000 Inoue et al. ..... 271/4.08
6,318,716 B1 * 11/2001 Okuda ..... 271/121
6,540,221 B2 * 4/2003 Nakashima et al. ..... 271/121
7,128,316 B2 * 10/2006 Nakano et al. ..... 271/121
7,431,289 B2 * 10/2008 Sekiyama et al. ..... 271/188
7,497,432 B2 * 3/2009 Ikeda ..... 271/121
7,618,036 B2 * 11/2009 Ikeda ..... 271/121
7,681,880 B2 * 3/2010 Sekiyama et al. ..... 271/188
2002/0185804 A1 * 12/2002 Wood et al. ..... 271/10.01
2003/0062668 A1 * 4/2003 Shibata et al. ..... 271/121

(Continued)

FOREIGN PATENT DOCUMENTS

JP 63-208451 8/1988

(Continued)

OTHER PUBLICATIONS

Office Action mailed Feb. 21, 2012 for corresponding Japanese Application No. 2008-112465.

*Primary Examiner* — Michael McCullough
*Assistant Examiner* — Howard Sanders
(74) *Attorney, Agent, or Firm* — Harness, Dickey & Pierce, P.L.C.

(57) ABSTRACT

A sheet feeding device includes a sheet feeding member, a friction separation member, a retaining member, a downstream guiding member, and a biasing member. The downstream guiding member is arranged downstream of a sheet conveyance direction than the friction separation member such that its guide surface is inclined at a predetermined angle to a front surface of the friction separation member towards the sheet feeding member. A line joining an apex of a sheet guiding member arranged upstream of the sheet conveyance direction than the friction separation member and an apex of the downstream guiding unit is positioned towards the sheet feeding member than a contact portion of the sheet feeding member and the friction separation member.

22 Claims, 11 Drawing Sheets

U.S. PATENT DOCUMENTS

| | | | | |
|---|---|---|---|---|
| 2005/0200071 | A1* | 9/2005 | Ikeda | 271/121 |
| 2006/0237900 | A1* | 10/2006 | Sekiyama et al. | 271/220 |

FOREIGN PATENT DOCUMENTS

| | | |
|---|---|---|
| JP | 07-285705 | 10/1995 |
| JP | 2002-002994 | 1/2002 |
| JP | 2002-347965 | 12/2002 |
| JP | 2003-267573 | 9/2003 |
| JP | 2004-123376 | 4/2004 |
| JP | 2004-189350 | 7/2004 |
| JP | 2005-343582 | 12/2005 |
| JP | 2006-117384 | 5/2006 |
| JP | 2007-137559 | 6/2007 |

* cited by examiner

SHEET FEEDING DEVICE AND IMAGE FORMING APPARATUS

CROSS-REFERENCE TO RELATED APPLICATIONS

The present application claims priority to and incorporates by reference the entire contents of Japanese priority document 2007-290674 filed in Japan on Nov. 8, 2007, Japanese priority document 2008-22726 filed in Japan on Feb. 1, 2008, and Japanese priority document 2008-112465 filed in Japan on Apr. 23, 2008.

BACKGROUND OF THE INVENTION

1. Field of the Invention

The present invention relates to a technology for feeding sheets in an image forming apparatus.

2. Description of the Related Art

In typical image forming apparatuses, a sheet feeding device employing a friction pad separation method is used, in which recording sheets or originals are separated one by one for sheet feeding. Such sheet feeding device employing the friction pad separation method includes a rotatable sheet loading board and a friction-member supporting member. The sheet loading board is disposed such that an uppermost sheet among stacked sheets is biased towards a pickup roller or a sheet feeding roller by using a pressing unit such as a spring. The friction-member supporting member similarly biases a friction pad (a friction member) towards the sheet feeding roller by using the pressing unit and separates sheets that have been fed towards the sheet feeding roller from the sheet loading board one by one by using the friction member. At that time, if a pressure (hereinafter, "sheet feeding pressure") of the sheet loading board is too high, a supply capability of the sheets increases. Therefore, the sheets are not separated by the friction member and double sheet feeding occurs. If the sheet feeding force is too low, the supply capability of the sheets decreases than a conveyance load due to the friction member etc., and sheet feeding fails. On the other hand, when a pressure (hereinafter, "separation pressure") of the friction-member supporting member is too low, a frictional force sufficient for sheet separation is not obtained, and double sheet feeding occurs. If the separation force is too high, abnormal noise is generated due to stick-slip (a phenomenon involving a minute repetition of an operation in which a sheet is momentarily stopped on the friction pad and then conveyed) between the friction member and a sheet. To prevent such problems, the sheet feeding pressure and the separation pressure need to be set in an appropriate level.

The appropriate level for the sheet feeding pressure and the separation pressure differs according to a sheet type such as thick sheets and thin sheets. Normally, because thick sheets are hard, conveyance load increases and a feeding failure is likely to occur. On the other hand, thin sheets are likely to cause double sheet feeding. To make the sheet feeding device compatible with various sheet types, it is necessary to set the sheet feeding pressure and the separation pressure in a common appropriate level that can support various sheet types. However, if a width corresponding to a sheet weight of the sheet feeding device is wide, the common appropriate level does not exist.

In a technology disclosed in Japanese Patent Application Laid-open No. 2004-189350, even when a length of the sheet feeding roller cannot be adequately secured, squealing (abnormal noise), double sheet feeding, feeding failure occurring in the friction-pad separation method can be controlled.

In the above technology, a central portion of a friction pad is disposed opposite to the sheet feeding roller and both side portions of the friction pad are disposed on both sides of the sheet feeding roller. Thus, a level difference is created by sinking the central portion of the friction pad with respect to both side portions. Moreover, a magnitude relation for the width is set such that the width of the sheet feeding roller is thinner than the width of the central portion of the pad and the recording media are compressed into a depression of the friction pad by using the sheet feeding roller.

In a technology disclosed in Japanese Patent Application Laid-open No. 2005-343582, a simple structure is suggested in which sheets do not rub against left and right edges of the friction pad and the sheets are not damaged or curled. For that, an inclined guiding unit is set at a portion of the friction pad that carries sheets, and the friction pad is disposed downstream of a sheet conveyance direction of the guiding unit. Further, ribs that can move higher than an upper surface of the friction pad are vertically arranged on both sides of a rear end of the disposed portion of the friction pad with respect to the sheet conveyance direction. Moreover, the sheet feeding roller is disposed on a peripheral central portion of a sheet feeding collar set concentrically with a shaft and narrow pressure rollers are arranged on both end portions of the sheet feeding roller. A diameter of the pressure roller is set slightly shorter than the diameter of the sheet feeding roller, and both side portions that are parallel to the sheet conveyance direction are held down such that both side portions do not rise upward.

SUMMARY OF THE INVENTION

It is an object of the present invention to at least partially solve the problems in the conventional technology.

According to an aspect of the present invention, there is provided a sheet feeding device that includes a sheet feeding member that feeds a sheet; a friction separation member that separates overlapped sheets by friction; a retaining member that retains the friction separation member; a downstream guiding member that is fixed to the retaining member downstream of a sheet conveyance direction than the friction separation member such that a guide surface of the downstream guiding member is inclined at a predetermined angle to a top surface of the friction separation member toward the sheet feeding member; a biasing member that biases the friction separation member to be brought into contact with the sheet feeding member; and a sheet guiding member arranged upstream of the sheet conveyance direction than the friction separation member, wherein a line that joins a first apex being an apex of a guide surface of the sheet guiding member and a second apex being an apex of the guide surface of the downstream guiding member is positioned toward the sheet feeding member than a contact portion of the sheet feeding member and the friction separation member.

According to another aspect of the present invention, there is provided an image forming apparatus that includes a feeding device including a sheet feeding member that feeds a sheet; a friction separation member that separates overlapped sheets by friction; a retaining member that retains the friction separation member; a downstream guiding member that is fixed to the retaining member downstream of a sheet conveyance direction than the friction separation member such that a guide surface of the downstream guiding member is inclined at a predetermined angle to a top surface of the friction separation member toward the sheet feeding member; a biasing member that biases the friction separation member to be brought into contact with the sheet feeding member; and a sheet guiding member arranged upstream of the sheet conveyance direction than the friction separation member, wherein a line that joins a first apex being an apex of a guide surface of the sheet guiding member and a second apex being an apex of the guide surface of the downstream guiding member is positioned toward the sheet feeding member than a contact portion of the sheet feeding member and the friction separation member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
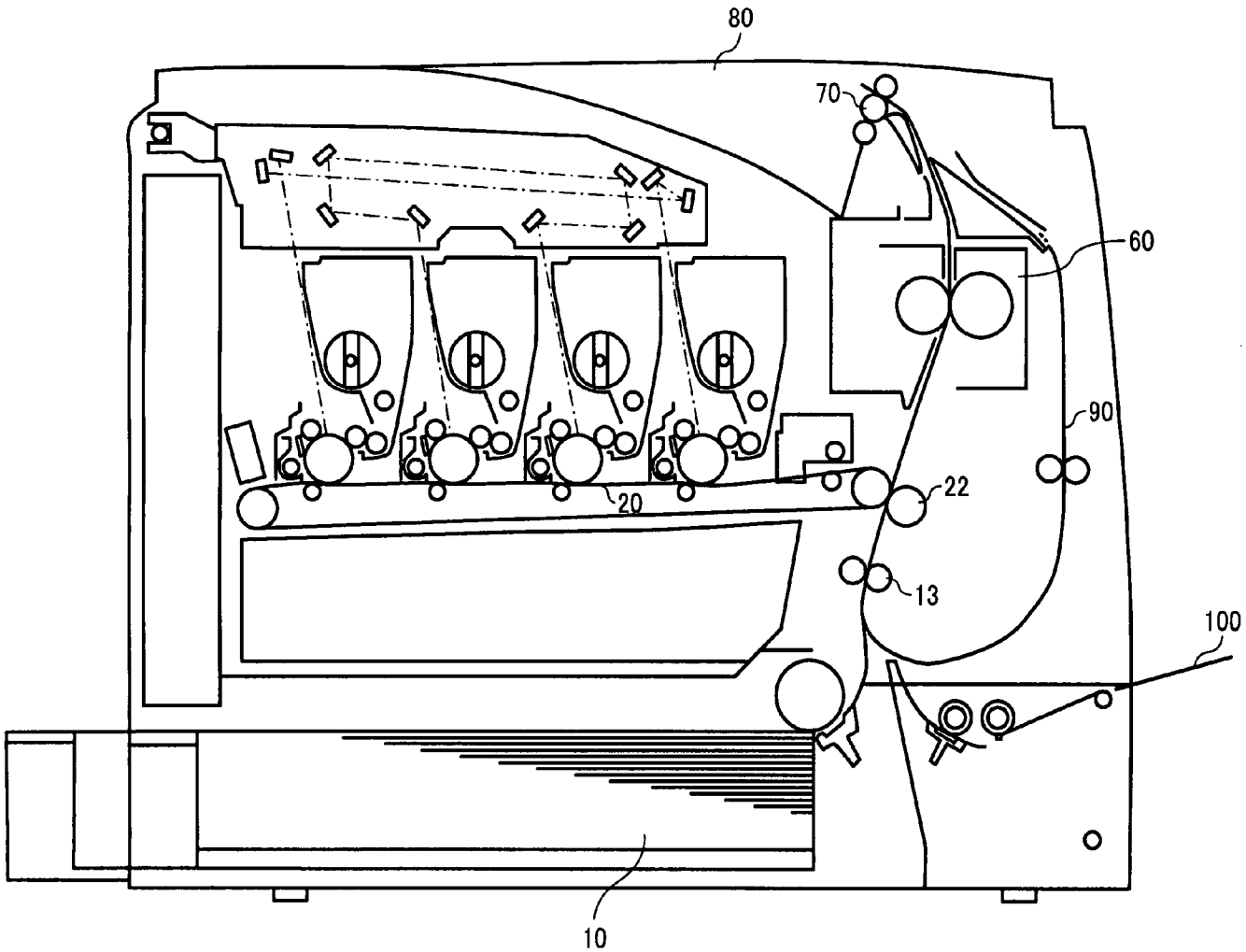
FIG. 1 is a schematic diagram of an image forming apparatus according to a first embodiment of the present invention.

Exemplary embodiments of the present invention are explained in detail below with reference to the accompanying drawings. FIG. 1 is a schematic diagram of an image forming apparatus that includes a sheet feeding device according to a first embodiment of the present invention. The image forming apparatus shown in FIG. 1 is a laser printer including photosensitive bodies, exposure units, developing units etc. In the image forming apparatus, an image formed by an electrophotographic method is primary transferred to an intermediate transfer belt 20 and secondary transferred to a sheet by using a secondary transfer roller 22 that is pressed against the intermediate transfer belt 20 in a secondary transfer unit. A sheet is sent from a cassette-type sheet-feeding tray 10 or a manual tray 100 by a sheet feeding mechanism and fed to the secondary transfer unit via a pair of registration rollers 13. An image is transferred onto the sheet and then fixed on the sheet by a fixing device 60. In single-sided image formation, the sheet is discharged to a discharge tray 80 by a pair of discharge rollers 70. In double-sided image formation, the sheet having the image transferred and fixed on one surface is fed again by a sheet reversing unit 90 to the secondary transfer unit via the registration rollers 13. An image is transferred and fixed on a reverse surface of the sheet, and the sheet is discharged to the discharge tray 80.

Figure 2:
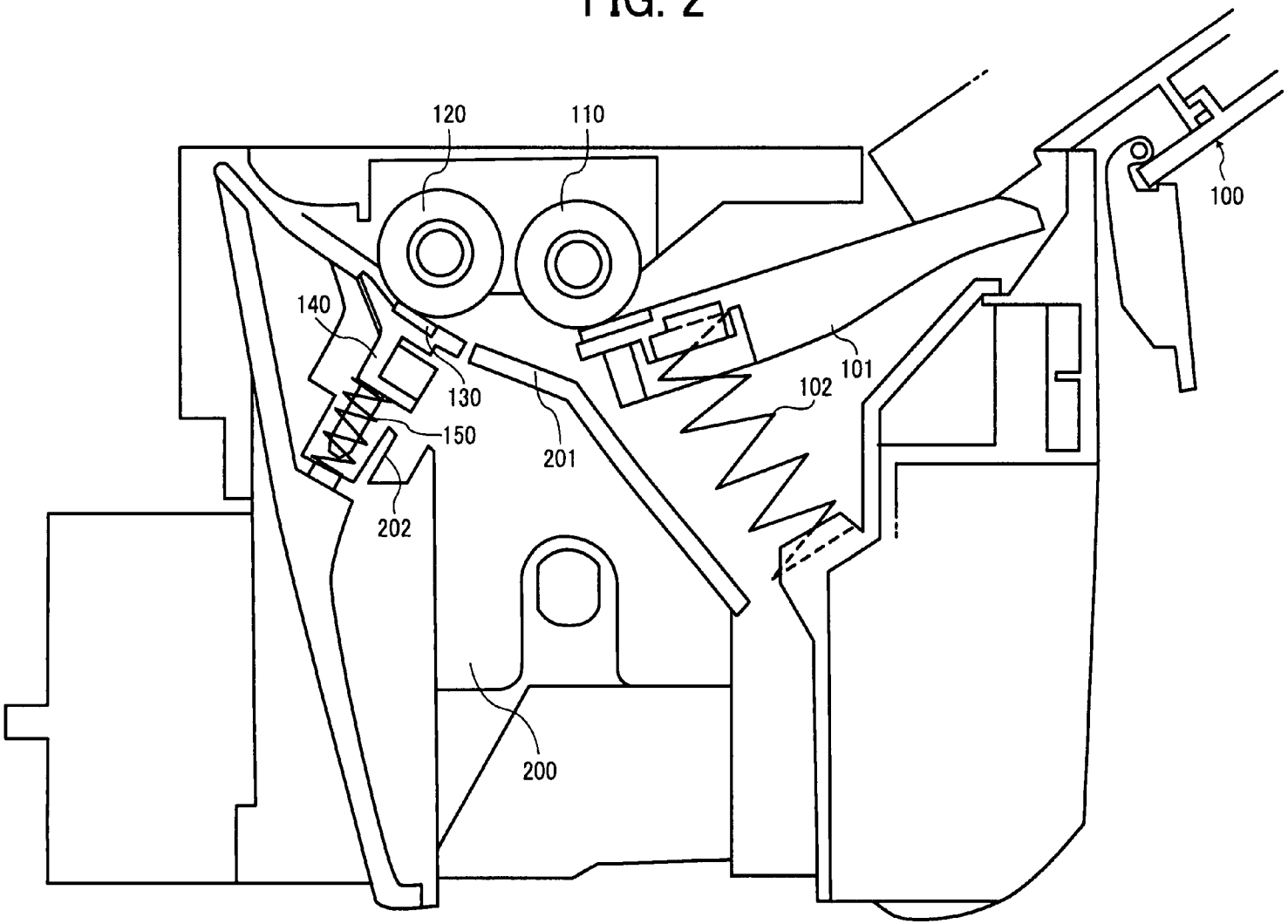
FIG. 2 is a schematic diagram of a manual sheet feeding device and a manual tray according to the first embodiment.

The sheet feeding device according to the embodiments is explained as a manual sheet-feeding device that feeds sheets loaded on the manual tray 100. However, the sheet feeding device can also be applied to the cassette-type sheet-feeding tray 10. FIG. 2 is a schematic diagram of the manual tray 100 and a manual sheet feeding device.

A sheet loading unit of the manual sheet feeding device includes a bottom plate 101 and the manual tray 100 that is openable and closable. The manual sheet-feeding device includes a pickup roller 110 that feeds a sheet from the bottom plate 101, a sheet feeding roller 120 that separates sheets one by one and conveys separated sheets to the registration rollers 13 (see FIG. 1), a friction pad 130 that serves as a friction separation member, and a retaining member 140 that retains the friction pad 130. The bottom plate 101 is biased towards the pickup roller 110 by a spring 102, and also moved up and down by a cam (not shown). Thus, at the time of a sheet feeding operation, the sheet is caused to connect to and separate from the pickup roller 110 at a predetermined timing. The retaining member 140 is flexibly supported inside a main housing 200 and biased towards the sheet feeding roller 120 by a spring 150. The friction pad 130 is made of a material that can obtain a frictional force necessary for a sheet and brought into contact with the sheet feeding roller 120 due to a predetermined contact pressure.

A sheet guide 201 is arranged in the main housing 200. The sheet guide 201 guides a sheet fed by the pickup roller 110 towards a sheet separating unit constituted of the sheet feeding roller 120 and the friction pad 130. The sheet guide 201 is inclined with respect to a conveyance direction of a sheet conveyed from a sheet loading unit by the pickup roller 110, so that a sheet can be guided towards the sheet separating unit. The sheet guide 201 includes a function of changing a sheet conveyance direction and a pre-separation function of loosening a bundle of sheets when a plurality of sheets are fed by the pickup roller 110 and upon leading edges of the sheets touch the sheet guide 201.

After the leading edge of a sheet passes over the sheet guide 201, the sheet is transferred towards the sheet feeding roller 120 while touching mainly an apex of an inclined surface of the sheet guide 201. After a sheet is transferred to the sheet feeding roller 120, the bottom plate 101 is moved downward by the cam (not shown) and thereby a pressure contact between the sheet and the pickup roller 110 by the spring 102 is released.

Figure 3:
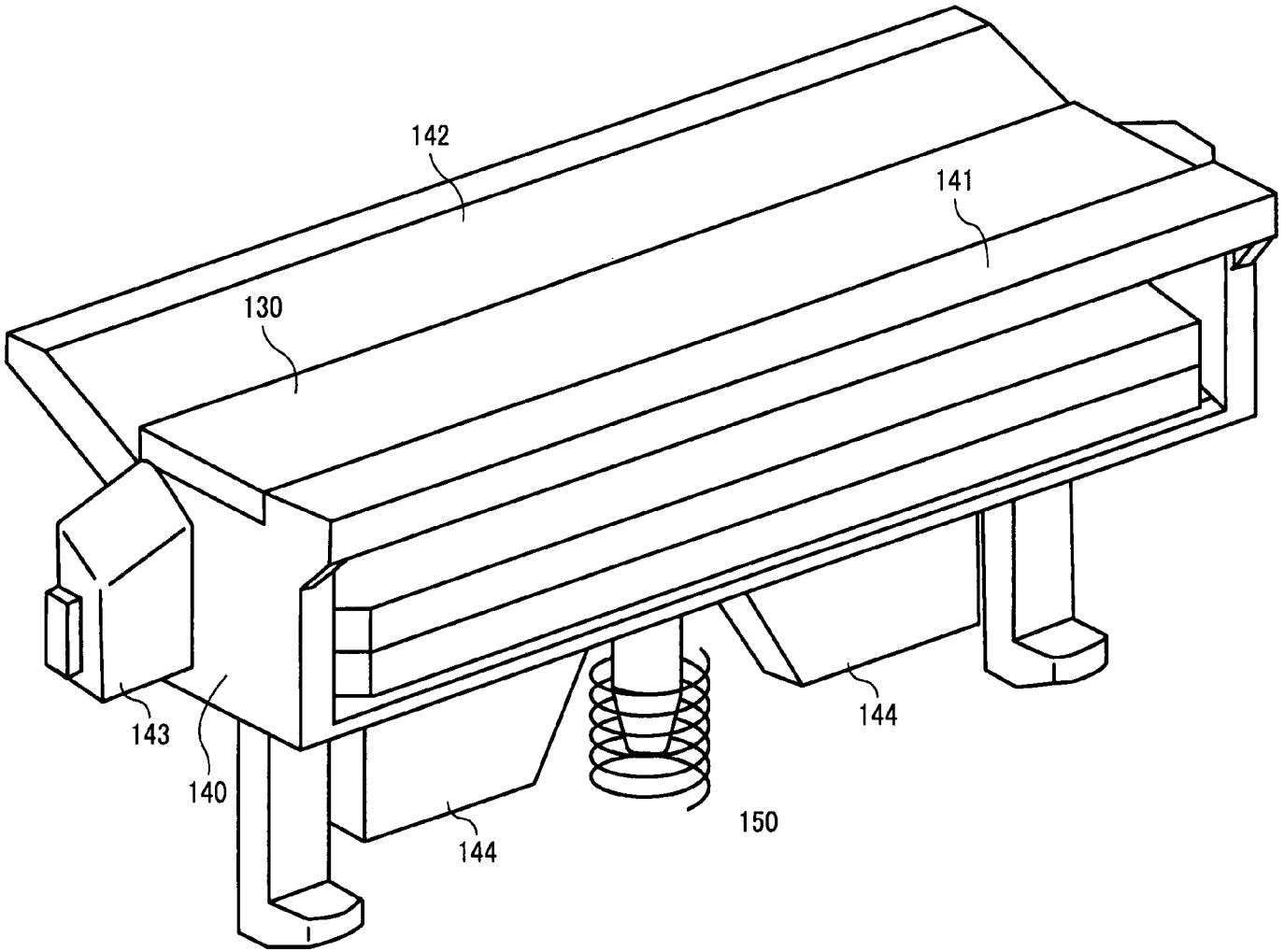
FIG. 3 is a perspective view of the sheet feeding device shown in FIG. 2.
Figure 4:
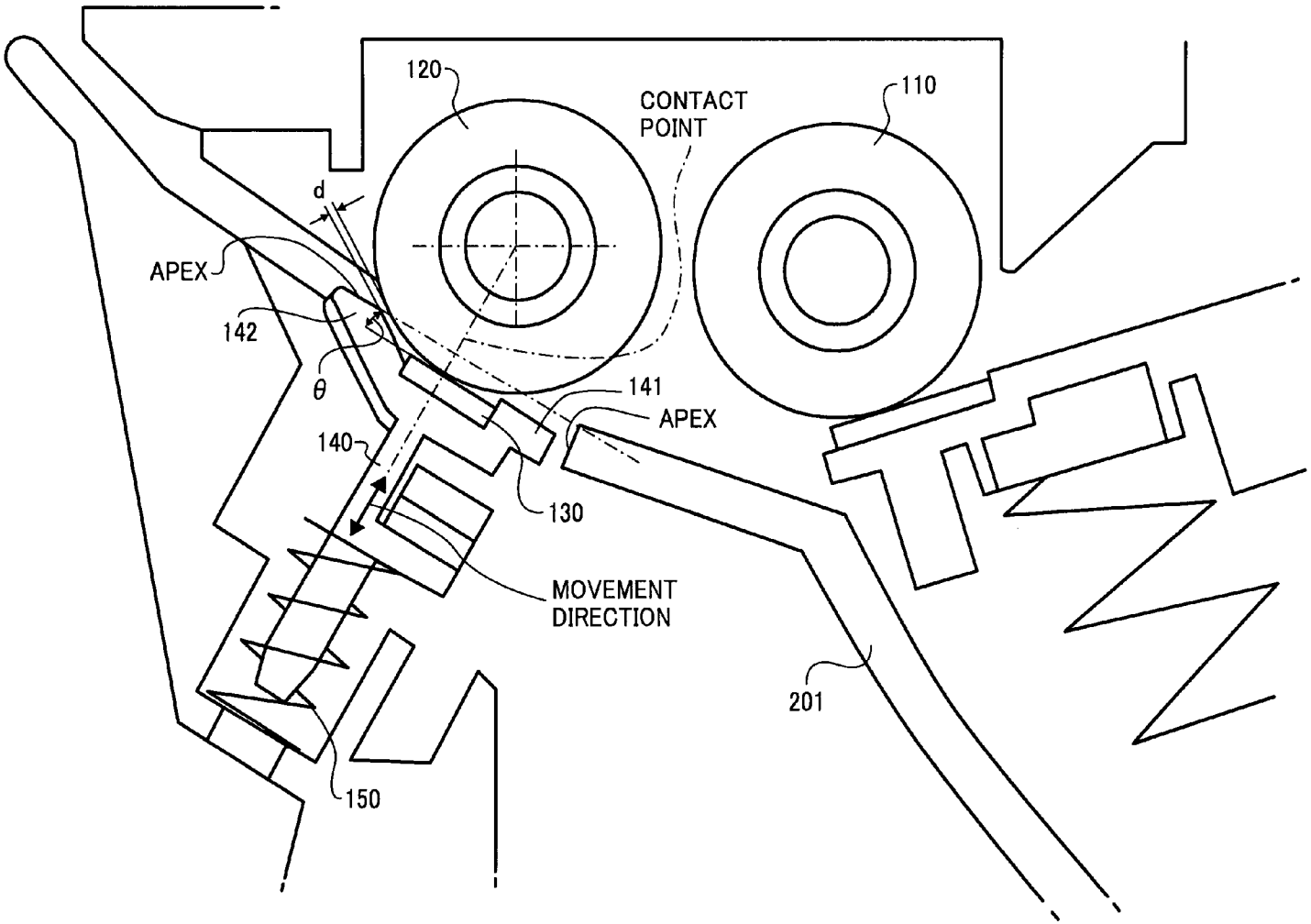
FIG. 4 is a schematic diagram for explaining a salient structure of the sheet feeding device shown in FIG. 2.

As shown in FIG. 3, the retaining member 140 includes an upstream sheet guiding unit 141 upstream of a sheet conveyance direction of the friction pad 130 and a sheet guiding unit 142 downstream of the sheet conveyance direction. A width of each of the upstream sheet guiding unit 141 and the downstream sheet guiding unit 142 in a direction that is orthogonal to the sheet conveyance direction is wider than a width of the sheet feeding roller 120. A resin material, for example, Teflon (registered trademark, polytetrafluoroethylene) having a coefficient of friction less than a coefficient of friction of the friction pad 130 and an abrasion resistant higher than an abrasion resistant of the friction pad 130 is used as a principal material for at least a guide surface of each of the upstream sheet guiding unit 141 and the downstream sheet guiding unit 142. As shown in FIG. 4, when a sheet that passes over a contact portion of the sheet feeding roller 120 and the friction pad 130 is conveyed forward, the leading edge of the sheet touches the downstream sheet guiding unit 142, and then the downstream sheet guiding unit 142 guides the sheet so that the sheet is conveyed towards the sheet feeding roller 120. To guide a sheet in the above manner, the downstream sheet guiding unit 142 has a guide surface inclined at an angle θ in a range from 20 degrees to 35 degrees to a front surface of the friction pad 130 towards the sheet feeding roller 120. The downstream sheet guiding unit 142 is positioned away from the sheet feeding roller 120 by a distance "d" in a range from 0.4 millimeter to 0.6 millimeter. Moreover, because the upstream sheet guiding unit 141 suppresses rushing in of sheets all at once onto the friction pad 130, the upstream sheet guiding unit 141 is positioned away from the sheet feeding roller 120 by 0.4 millimeter to 0.6 millimeter. When disposing the upstream sheet guiding unit 141 close to the sheet feeding roller 120, if setting is carried out such that the apices of the upstream sheet guiding unit 141 and the downstream sheet guiding unit 142 are spaced at an equal distance on a straight line joining the following three points, which are a center of the spring 150, a contact point of the friction pad 130 and the sheet feeding roller 120, and a center of rotation of the sheet feeding roller 120, a reaction force acting on the retaining member 140 due to a rigidity of curved sheets is exerted uniformly on each of the upstream sheet guiding unit 141 and the downstream sheet guiding unit 142. Thus, displacement of a rotation direction of the retaining member 140 can be controlled in terms of power balance.

As shown in FIG. 3, the retaining member 140 includes symmetrical supporting members 143 and rotation regulating members 144. The supporting members 143 fit into slit-like supporting grooves (not shown) arranged on the main housing 200 and are arranged on both lateral faces in the direction orthogonal to the sheet conveyance direction. The rotation regulating members 144 are arranged on both sides of a biasing position of the spring 150. A rotation direction displacement (distortion) of the retaining member 140, which is likely to occur due to a backlash between the supporting grooves of the main housing 200 and the supporting members 143, can be regulated by suppressing the rotation regulating members 144 by using a regulating rib 202 arranged on the main housing 200. Thus, in such a structure, it is ensured that the retaining member 140 is guided in the same direction as the biasing direction of the spring 150.

As shown in FIG. 4, the retaining member 140 is flexibly supported in a linear direction towards the center of rotation of the sheet feeding roller 120, and the spring 150 biases the retaining member 140 towards the center of rotation of the sheet feeding roller 120. The friction pad 130 is retained by the retaining member 140 such that the friction pad 130 touches the sheet feeding roller 120 at the contact point at an angle by which the friction pad 130 coincides with a tangential direction of the sheet feeding roller 120. Furthermore, the contact point can undergo a minute displacement on a movable line of the retaining member 140. In other words, a straight line joining the contact point on a central sectional surface and the center of rotation of the sheet feeding roller 120 coincides with a movement direction of the retaining member 140 and a biasing direction (or a central shaft line of the spring) of the spring 150. Thus, by setting a position of the friction pad 130, the movement direction of the retaining member 140, and the biasing direction as described above, oscillations etc. of the friction pad 130 and the retaining member 140 occurring at the time of separating and feeding sheets can be prevented and the abnormal noise can also be prevented.

When a plurality of sheets are fed by the pickup roller 110 from the sheet loading unit to the sheet separating unit constituted of the sheet feeding roller 120 and the friction pad 130, the frictional force between the friction pad 130 and a sheet becomes greater than the frictional force between sheets. Therefore, sheets can be separated and only one sheet on the sheet feeding roller 120 can be fed. Although a separation performance of sheets increases as the biasing force of the spring 150 increases, abnormal noise due to frictional separation is likely to occur. Because abnormal noise due to the friction separation is likely to occur when a sheet conveyance speed is low, thick sheets that are often fed slowly for fixing the image on the sheets frequently cause abnormal noise. On the other hand, when the biasing force of the spring 150 is low, insufficient sheet separation takes place and "double sheet feeding" is likely to occur in which a plurality of sheets are fed. Further, an increase in the biasing force increases abrasion of the friction pad 130, resulting in reducing durability of separation performance over a period of time.

Sheets that are separated and fed one by one by the sheet feeding roller 120 and the friction pad 130 are guided by the downstream sheet guiding unit 142 of the retaining member 140 to lean the conveyance direction towards the sheet feeding roller 120. Therefore, reaction force is generated and exerted on the retaining member 140 in a direction opposite to the biasing force of the spring 150, depending on the rigidity of bent sheets. A magnitude of the reaction force, which is determined according to the magnitude of the rigidity of sheets, is greater for thick sheets and lesser for thin sheets.

Figure 5:
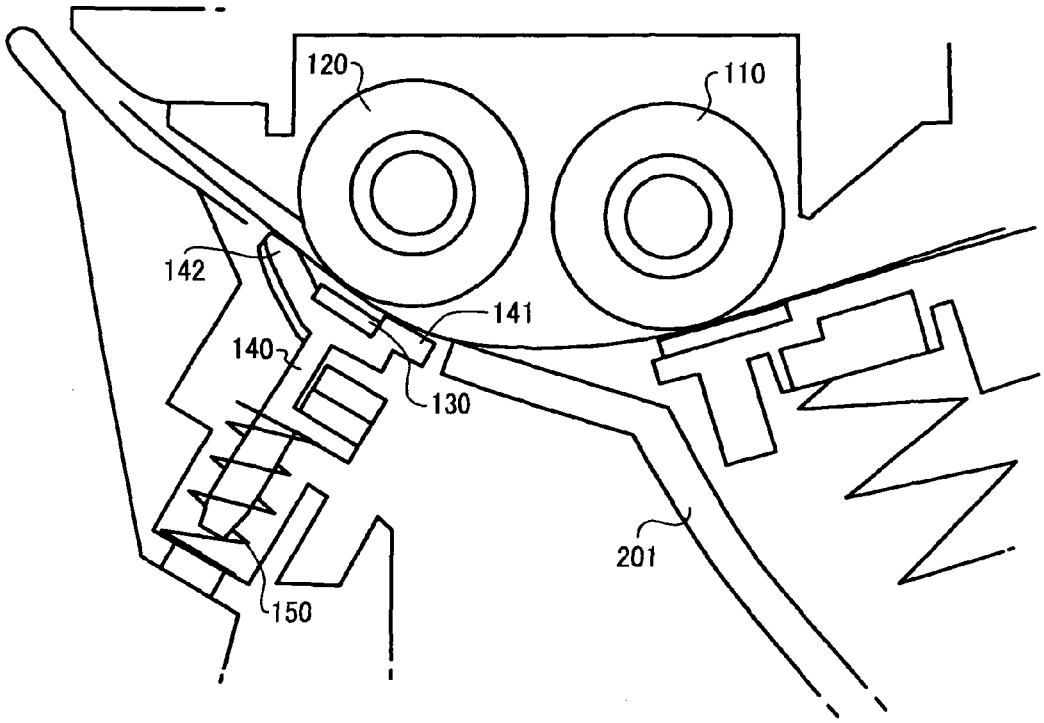
FIG. 5 is a schematic diagram of the sheet feeding device shown in FIG. 2 when a thick sheet is being fed.
Figure 6:
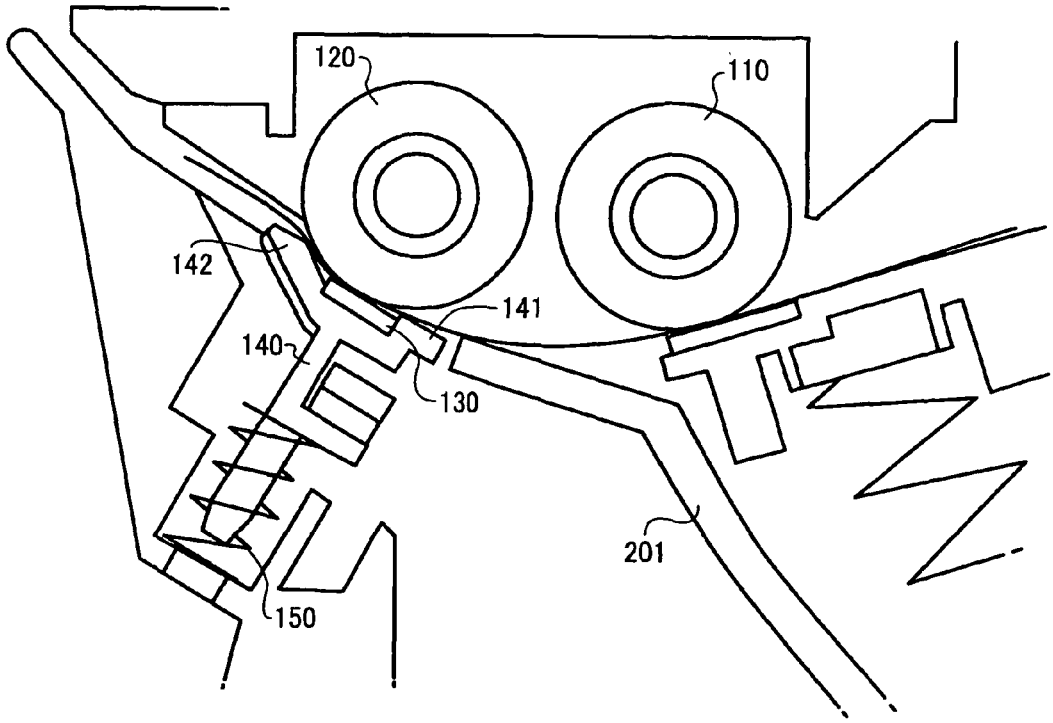
FIG. 6 is a schematic diagram of the sheet feeding device shown in FIG. 2 when a thin sheet is being fed.

Moreover, as shown in FIG. 4, a straight line joining the apex of the sheet guide 201 and the apex of the downstream sheet guiding unit 142 of the retaining member 140 is towards the sheet feeding roller 120 from the contact point of the sheet feeding roller 120 and the friction pad 130. Therefore, when feeding thick sheets that are highly rigid, a pressure contact between the friction pad 130 and a thick sheet is reduced as shown in FIG. 5, stick-slip between the friction pad 130 and the thick sheet becomes less likely to occur, and abnormal noise can be suppressed. Because the straight line joining the apex of the sheet guide 201 and the apex of the downstream sheet guiding unit 142 is perpendicular to the biasing direction of the spring 150, the reaction force that is exerted on the retaining member 140 based on the rigidity of a bent sheet can be efficiently exerted as the force that resists the biasing force of the spring 150. Further, because the pressure contact with the friction pad 130 is reduced, a sheet receives less frictional force from the friction pad 130, and the conveyance load is reduced. On the other hand, because a sheet is supported by the downstream sheet guiding unit 142 of the retaining member 140 and the sheet guide 201, a sufficient conveyance pressure is obtained from the sheet feeding roller 120 and thick sheets can be steadily fed. For thick sheets that are highly rigid, a greater pre-separation effect of the sheet guide 201 is posed and a sufficient separation performance can also be ensured. On the other hand, when feeding thin sheets in which double sheet feeding is likely to occur, because thin sheets have a low rigidity and a sheet reaction force that presses down the retaining member 140 against the biasing force of the spring 150 is weak, as shown in FIG. 6, the pressing contact force between a thin sheet and the friction pad 130 can be ensured and the steady separation performance can be obtained.

Thus, because the conveyance load on the friction pad 130 can be suppressed depending on sheet types, deterioration of the separation performance due to abrasion over a period of time can be reduced.

Figure 7:
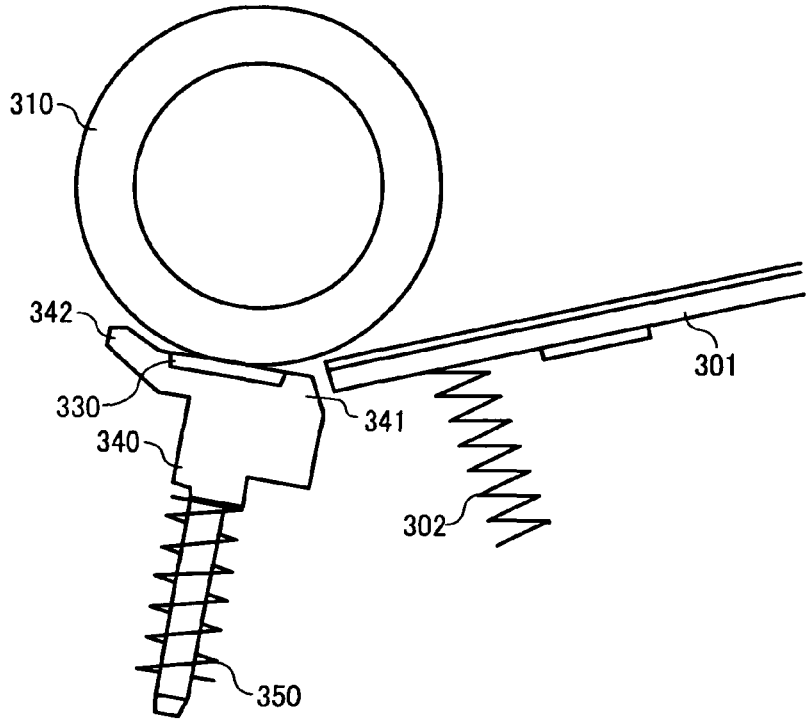
FIG. 7 is a schematic diagram of a sheet feeding device according to a second embodiment of the present invention.

A sheet feeding device according to a second embodiment of the present invention is explained below. The sheet feeding device carries out sheet feeding and conveyance by using a roller that combines functions of the pickup roller and the sheet feeding roller. FIG. 7 is a schematic diagram of the sheet feeding device according to the second embodiment. Sheets (not shown) loaded on a sheet loading board 301 are biased by using a spring 302 towards a sheet feeding roller 310. The sheet loading board 301 is movable and supported upstream of the sheet conveyance direction so that sheets are always biased towards the sheet feeding roller 310 irrespective of a sheet load. A friction pad 330 on a retaining member 340 is biased towards the sheet feeding roller 310 due to a pressing force of another spring 350. Therefore, when sheets are fed to the friction pad 330 from the sheet loading board 301, a fixed frictional force can be applied on the sheets. Even when a plurality of sheets are fed towards a contact portion of the sheet feeding roller 310 and the friction pad 330, only an uppermost sheet can be fed due to the frictional force.

The retaining member 340 includes an upstream sheet guiding unit 341 arranged upstream of the sheet conveyance direction and a downstream sheet guiding unit 342 arranged downstream of the sheet conveyance direction. Specifically, when a sheet that passes over the contact portion of the sheet feeding roller 310 and the friction pad 330 is conveyed forward, the leading edge of the sheet touches the downstream sheet guiding unit 342, and then the downstream sheet guiding unit 342 guides the sheet so that the sheet is conveyed towards the sheet feeding roller 310. Due to guide surfaces of the upstream sheet guiding unit 341 and the downstream sheet guiding unit 342, when thick sheets are fed, a force depending on the rigidity of thick sheets acts on the upstream sheet guiding unit 341 and the downstream sheet guiding unit 342 of the friction pad 330, in a direction opposite to a pressing direction of the spring 350. In the second embodiment, because the retaining member 340 includes both upstream and downstream guide surfaces, the force can be steadily exerted on the retaining member 340 against the biasing force.

Figure 8:
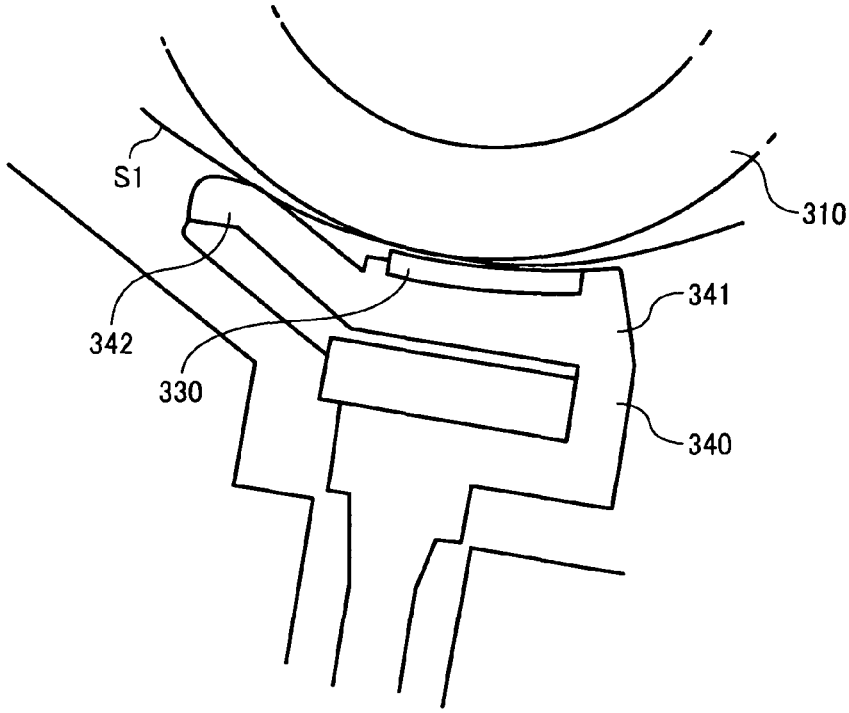
FIG. 8 is a schematic diagram of the sheet feeding device shown in FIG. 7 when a thick sheet is being fed.
Figure 9:
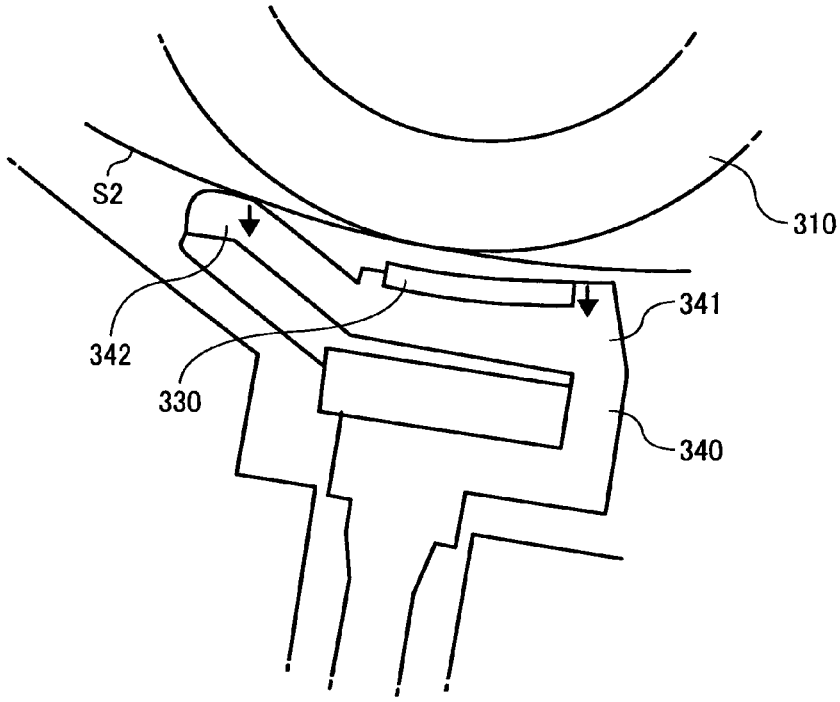
FIG. 9 is a schematic diagram of the sheet feeding device shown in FIG. 7 when a thin sheet is being fed.

FIG. 8 is a schematic diagram of a supporting board in the conveyance direction when conveying a thin sheet S. Because rigidity of the thin sheet S1 is weak, when conveying, the thin sheet S1 bends as shown in FIG. 8 and touches the friction pad 330. Thus, the thin sheet S1 is guided by the friction pad 330 and receives sufficient frictional force to be conveyed smoothly. On the other hand, because rigidity of thick sheets is strong as shown in FIG. 9, the pressing contact force on the friction pad 330 can be reduced by the upstream sheet guiding unit 341 and the downstream sheet guiding unit 342. Therefore, the frictional force received from the friction pad 330 is reduced, stick-slip between a thick sheet S2 and the friction pad 330 is eliminated, and abnormal noise can be prevented. Moreover, because a sufficient conveyance force is obtained from the sheet feeding roller 120 along with reducing the conveyance load due to the frictional force, thick sheets can be steadily fed. Further, because the conveyance load on the friction pad 330 can be suppressed depending on sheet types, deterioration of a feeding performance due to abrasion can be reduced.

Figure 10:
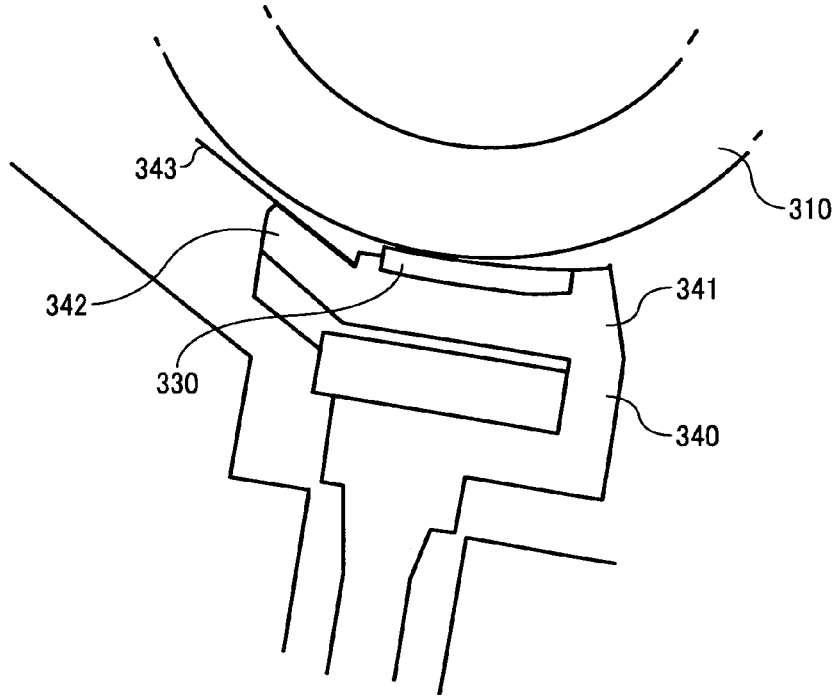
FIG. 10 is a schematic diagram of the sheet feeding device shown in FIG. 7 when an elastic member is fixed.
Figure 11:
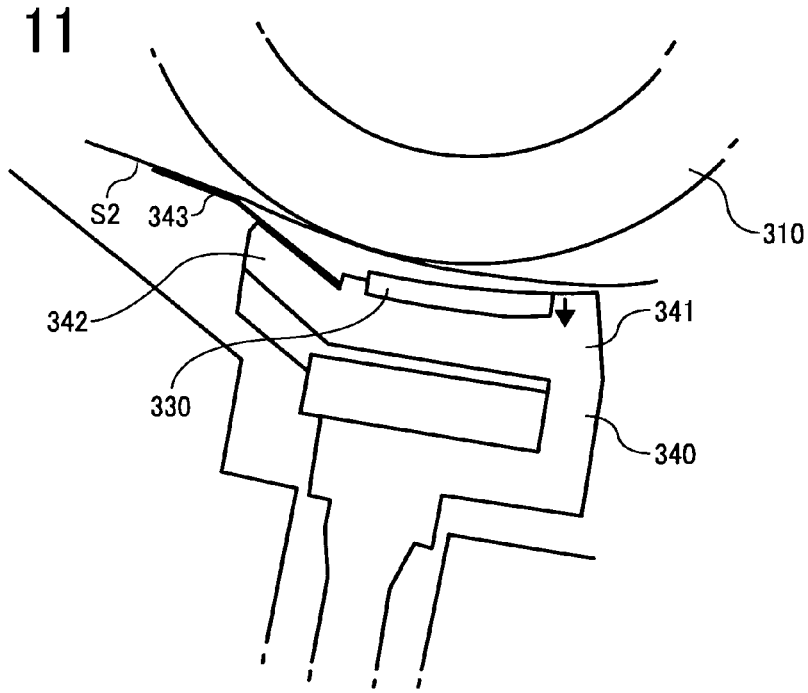
FIG. 11 is a schematic diagram of the sheet feeding device shown in FIG. 10 when a thick sheet is being fed.

As shown in FIG. 10, an elastic member 343 is cantilever-supported by the downstream sheet guiding unit 342 and extends downstream of the downstream sheet guiding unit 342. The downstream sheet guiding unit 342 arranged downstream of the sheet conveyance direction of the retaining member 340 guides a sheet that passes over the contact portion of the sheet feeding roller 310 and the friction pad 330 such that the sheet is conveyed towards the sheet feeding roller 310. Specifically when thick sheets are conveyed, because rigidity of thick sheets is strong, the thick sheets fail to bend along a curve on a conveyance path along the downstream sheet guiding unit 342, and a sheet feeding failure can occur. The elastic member 343 is arranged such that the sheet conveyance direction is oriented towards a desired sheet conveyance path and simultaneously a force is exerted in a direction in which sheets are separated from the friction pad 330 when hard sheets such as thick sheets are conveyed. In other words, by reducing the curve on the conveyance path along the downstream sheet guiding unit 342 by using elastic deformation of the elastic member 343, sheet feeding failure can be prevented for hard sheets. Simultaneously, the elastic member 343 is pressed by strength of thick sheets and an elastic force of the elastic member 343 functions as the reaction force to the biasing member and presses the supporting member in a direction opposite to the biasing direction. Therefore, the contact pressure between the friction separation member and a sheet feeding member is reduced, and the feeding failure and abnormal noise caused by thick sheets can be prevented by reducing the conveyance load on sheets due to the friction separation member.

Further, by arranging the elastic member 343, the conveyance direction is distinctly changed for thin sheets and thick sheets. Compared with thin sheets, thick sheets can easily elastically deform the elastic member 343 by the strength of the thick sheets and thereby the conveyance direction is oriented downward. In the second embodiment, the elastic member 343 is arranged such that the elastic member 343 is not positioned lower than the conveyance path downstream of the elastic member 343 (in other words, the conveyance path downstream of the elastic member 343 is set lower than a lowest position at which the elastic member 343 is lowered). Therefore, a sheet feeding failure and sheet jamming that occur between the elastic member 343 and a downstream side can be prevented. When thin sheets are fed, the conveyance direction is fixed irrespective of the elastic member 343 and thin sheets are always fed towards the sheet feeding member. Because rigidity of thin sheets is weak, thin sheets follow the guide members, and therefore a feeding failure is less likely to occur. When thin sheets or plain sheets that are not hard are conveyed, it is not required to resist a spring force of the retaining member 340. When thick sheets that are hard are conveyed, a an elastic force on the sheets and the spring force need to be balanced for releasing the pressure contact of the friction pad 330 towards the sheet feeding roller 310 against the spring force. However, to apply the elastic force of the elastic member 343 only on thick sheets without affecting the conveyance direction of a sheet that has passed over the contact portion, a bending stiffness of the elastic member 343 needs to have a concrete value as explained below. In the second embodiment, the bending stiffness for plain sheets is taken as 40 $N/m^2$ and for thick sheets is taken as 100 $N/m^2$ to 350 $N/m^2$. Thus, by taking the bending stiffness of the elastic member 343 as 50 $N/m^2$ to 100 $N/m^2$, an intended effect can be obtained only for thick sheets. The elastic member can be fixed to the downstream sheet guiding unit 142 that is downstream of the sheet conveyance direction and that is arranged on the retaining member 140 explained in the first embodiment.

Figure 12:
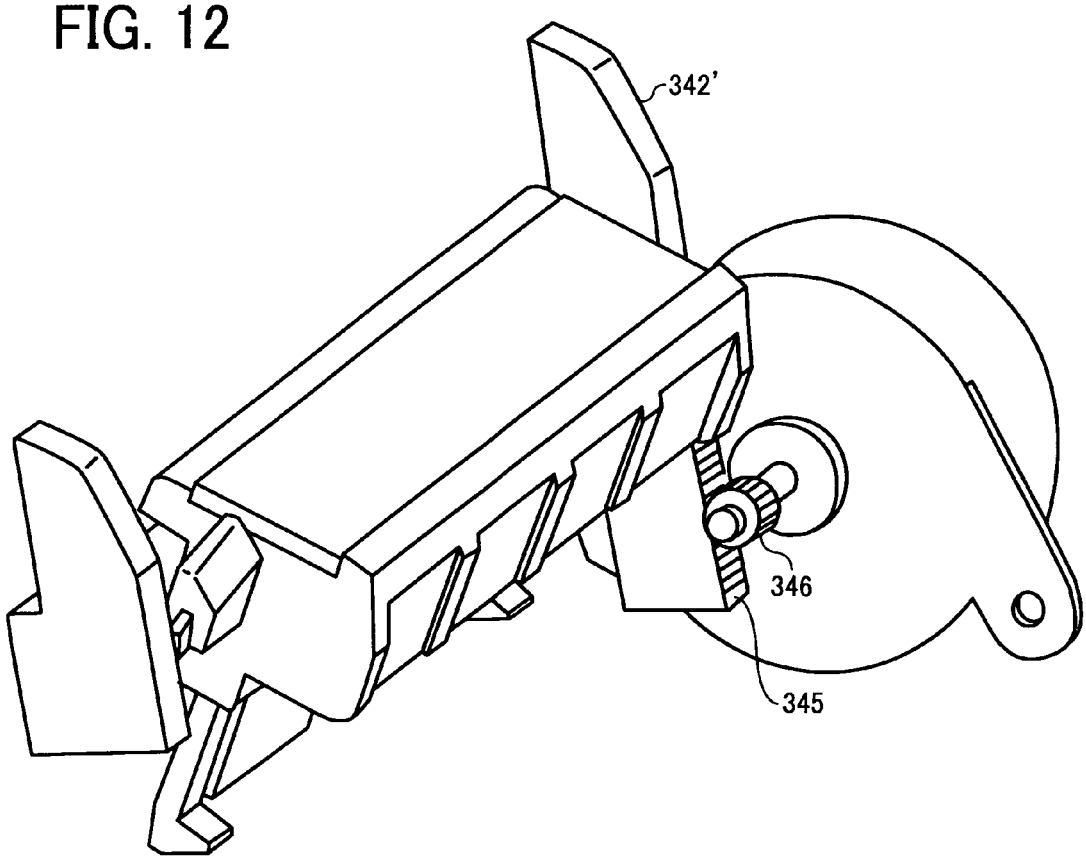
FIG. 12 is a perspective view of a mechanism that moves a downstream sheet guiding member.
Figure 13A:
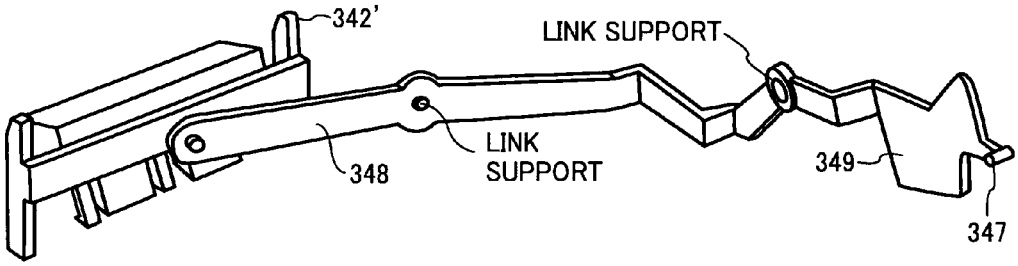
FIG. 13A is a schematic diagram of a link mechanism that connects a guiding unit and an operating unit for manually changing a relative position of a downstream sheet guiding unit and a sheet feeding roller.
Figure 13B:
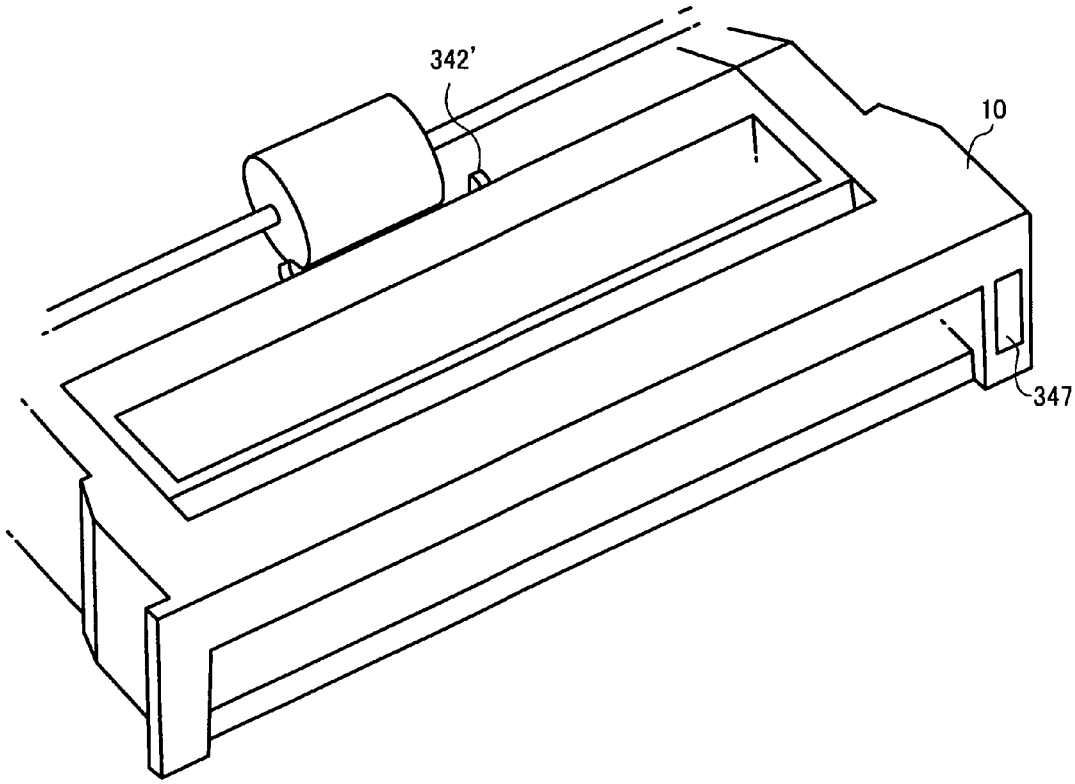
FIG. 13B is a perspective view for explaining a position where the operating unit shown in FIG. 13A is arranged in a sheet feeding tray.

A third embodiment of the present invention is explained below with reference to a cassette-type sheet-feeding tray in which a relative distance of a downstream sheet guiding unit with respect to the sheet feeding roller can be modified based on sheet feeding specifications (sheet thickness etc.) as compared to the second embodiment in which the conveyance force obtained from the sheet feeding roller and a load on the friction pad change depending on the strength of sheets. The third embodiment differs from the first and the second embodiments in that the downstream sheet guiding unit is separated from the retaining member. As shown in FIG. 12, a rack 345, which is formed on an opposite side of a sheet feeding roller side of the guiding members, is engaged with a gear 346, which is driven by a driving motor (not shown). With this configuration, a separated downstream sheet guiding unit 342' can displace up and down and change the relative position with respect to the sheet feeding roller. By setting the sheet feeding specifications (sheet type) from a printer-driver setting screen (not shown), the relative position of the downstream sheet guiding unit 342' with respect to the sheet feeding roller is modified in the above structure depending on the specifications. To enable carrying out setting of the relative position of the downstream sheet guiding unit with respect to the sheet feeding roller manually, as shown in FIGS. 13A and 13B, a user operating unit 347 is arranged on an anterior surface of the cassette-type sheet feeding tray 10. The user operating unit 347 is linked to the downstream sheet guiding unit 342' by using a link mechanism (a first link 348 and a second link 349) as shown in FIG. 13A and therefore the downstream sheet guiding unit 342' can be accordingly moved up and down.

Figure 14:
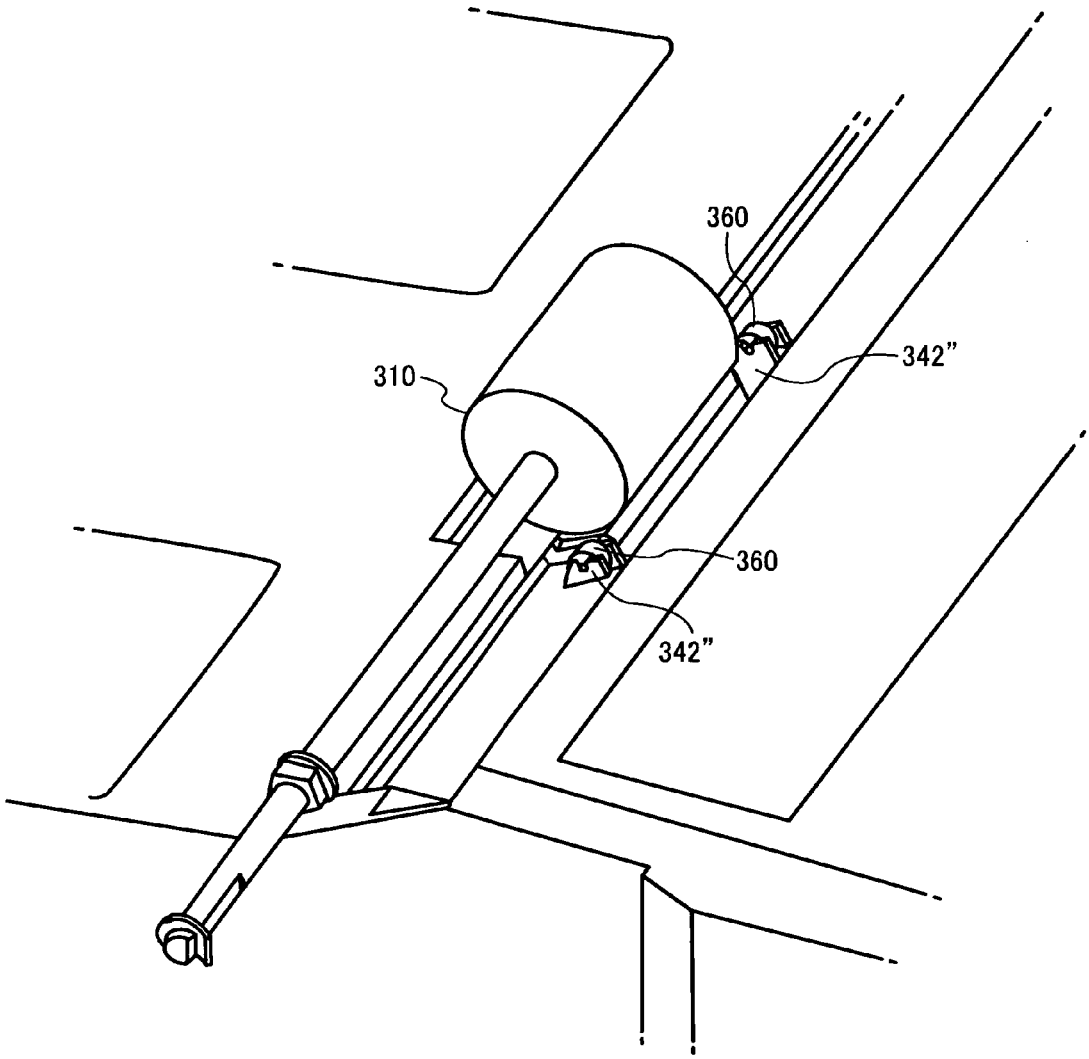
FIG. 14 is a perspective view of a mechanism including rollers arranged on the downstream sheet guiding unit.
Figure 15:
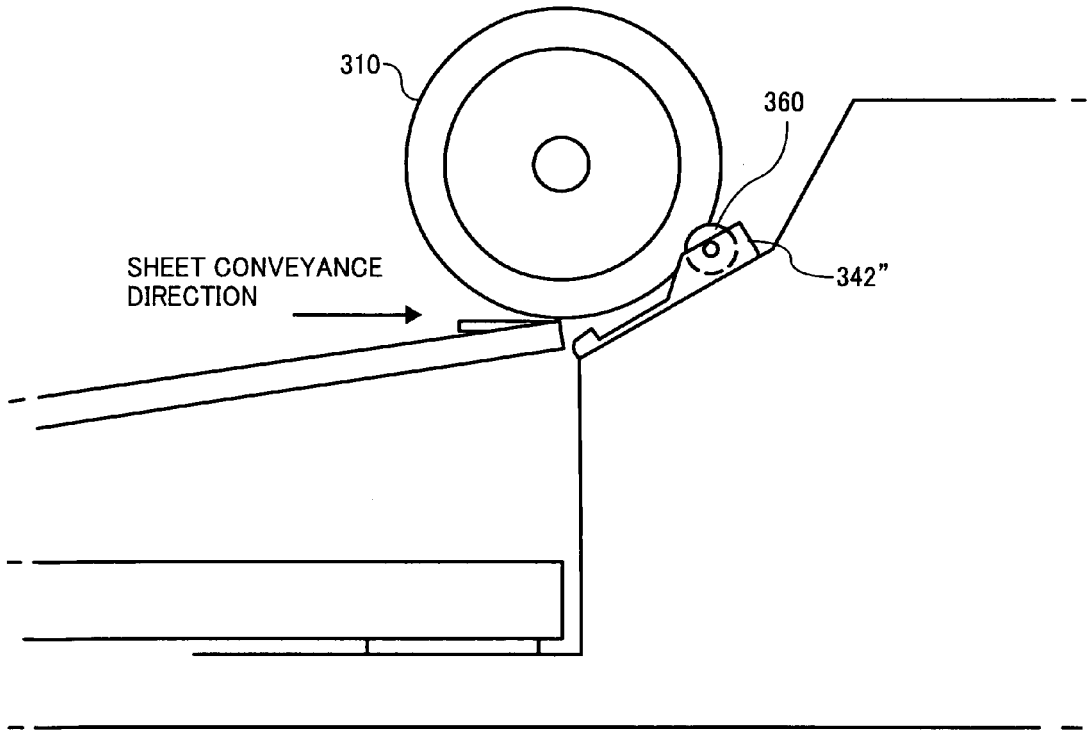
FIG. 15 is a side view of the mechanism shown in FIG. 14.

The resin material, for example, Teflon (registered trademark, polytetrafluoroethylene) having a coefficient of friction less than a coefficient of friction of the friction pad and that is abrasion resistant is used as the principal material for at least the guide surface of the downstream sheet guiding unit 342'. Further, as shown in FIG. 14 (a perspective view) and FIG. 15 (a side view), arranging a roller 360 on a sheet feeding roller side of a downstream sheet guiding unit 342" reduces a frictional resistance between a sheet and the downstream sheet guiding unit.

According to an aspect of the present invention, a feeding failure of thick sheets and abnormal noise can be prevented by reducing a contact pressure between the friction separation member and the sheet feeding member, and by reducing a sheet conveyance load due to the friction separation member. Moreover, abrasion of the friction separation member when feeding hard sheets can be suppressed.

According to another aspect of the present invention, a contact pressure between the friction separation member and the sheet feeding member can be reduced and the sheet conveyance load can be reduced in medium thick sheets that are weaker than thick sheets.

Furthermore, according to still another aspect of the present invention, sheet conveyance load on hard sheets being conveyed can be reduced and abnormal noise can certainly be prevented during an operating life of the friction separation member. Furthermore, a greater force can be exerted on the retaining member in the direction opposite to the biasing direction of the biasing member and a change in sheet orientation downstream of the sheet conveyance direction of the friction separation member can also be prevented.

Moreover, according to still another aspect of the present invention, sheet conveyance load of the friction separation member can be reduced and abnormal noise and feeding failure can be prevented.

Furthermore, according to still another aspect of the present invention, the degree of pressing sheets towards the sheet feeding roller can be decreased and a conveyance force can be increased depending on thickness of sheets. Moreover, conveyance load on hard sheets being conveyed can be reduced. Furthermore, an error in setting a degree of displacement of the downstream guiding unit can be eliminated.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device, comprising:

a sheet pick-up member to feed a sheet;

a sheet feeding member to separate the sheet;

a bottom plate which opposingly contacts the sheet pick-up member;

a first biasing member to press the bottom plate against the sheet pick-up member;

a friction separation member to separate overlapped sheets by friction, the friction separation member opposingly contacts the sheet feeding member;

a second biasing member to press the friction separation member against the sheet feeding member;

a retaining member retaining the friction separation member;

a downstream guiding member on the retaining member, the downstream guiding member being arranged downstream of the retaining member in a sheet conveyance direction, the downstream guiding member including a guide surface inclined at an angle relative to a top surface of the friction separation member toward the sheet feeding member; and a sheet guiding member arranged upstream of the friction separation member in the sheet conveyance direction, wherein the sheet guiding member is between the bottom plate and the retaining member and not in contact with neither the bottom plate nor the retaining member, a line that is connected between a first apex being an apex of a guide surface of the sheet guiding member and a second apex being an apex of the guide surface of the downstream guiding member is positioned closer to the sheet feeding member than a contact portion of the sheet feeding member and the friction separation member, and the sheet guiding member is a different member from the bottom plate and the retaining member.

2. The sheet feeding device according to claim 1, wherein the second biasing member biases the retaining member to be guided in a biasing direction of the second biasing member.

3. The sheet feeding device according to claim 1, wherein the sheet feeding member is a roller, and the second biasing member biases the friction separation member along a line joining the contact portion and a center of rotation of the sheet feeding member.

4. The sheet feeding device according to claim 3, wherein the line joining the first apex and the second apex is substantially perpendicular to a biasing direction of the second biasing member.

5. The sheet feeding device according to claim 1, further comprising an upstream guiding member fixed to the retaining member upstream of the sheet conveyance direction than the friction separation member.

6. The sheet feeding device according to claim 1, further comprising a mechanism that is fixed to the retaining member and regulates distortion of the retaining member with respect to the sheet conveyance direction.

7. The sheet feeding device according to claim 1, wherein the angle is in a range from 20 degrees to 35 degrees.

8. The sheet feeding device according to claim 1, wherein a distance between the guide surface of the downstream guiding member and the sheet feeding member is in a range from 0.4 millimeter to 0.6 millimeter.

9. The sheet feeding device according to claim 1, wherein a coefficient of friction of the guide surface of the downstream guiding unit is less than a coefficient of friction of the friction separation member.

10. The sheet feeding device according to claim 1, wherein the guide surface of the downstream guiding member is made of a material having an abrasion resistance higher than an abrasion resistance of the friction separation member.

11. The sheet feeding device according to claim 1, wherein a width of the guide surface of the downstream guiding member is wider than a width of the sheet feeding member in a shaft direction.

12. The sheet feeding device according to claim 1, further comprising an elastic member arranged on the downstream guiding member.

13. The sheet feeding device according to claim 12, wherein the elastic member is cantilever-supported by the downstream guiding member such that the elastic member extends downstream of the sheet conveyance direction.

14. The sheet feeding device according to claim 12, wherein the elastic member is set such that force can be applied to a sheet in a direction of separating the sheet from the friction separation member.

15. The sheet feeding device according to claim 1, wherein the downstream guiding member can move independent of the retaining member such that a relative position of the downstream guiding member and the sheet feeding member and to what degree the line joining the first apex and the second apex is inward than the contact portion are changed depending on a thickness of a sheet.

16. The sheet feeding device according to claim 15, wherein a coefficient of friction of the guide surface of the downstream guiding unit is less than a coefficient of friction of the friction separation member.

17. The sheet feeding device according to claim 15, wherein the downstream guiding member includes a roller.

18. The sheet feeding device according to claim 15, wherein relative positions of the downstream guiding member and the sheet feeding member are automatically set.

19. The sheet feeding device according to claim 1,
wherein the sheet pick-up member is arranged upstream of the sheet feeding member.

20. The sheet feeding device according to claim 1, wherein the retaining member is configured to translate towards the sheet feeding member independently of the sheet guiding member.

21. An image forming apparatus, comprising:
a feeding device including:
a sheet pick-up member to feed a sheet;
a sheet feeding member to separate the sheet;
a bottom plate which opposingly contacts the sheet pick-up member;
a first biasing member to press the bottom plate against the sheet pick-up member;
a friction separation member to separate overlapped sheets by friction, the friction separation member opposingly contacts the sheet feeding member;
a second biasing member to press the friction separation member against the sheet feeding member;
a retaining member retaining the friction separation member;
a downstream guiding member on the retaining member, the downstream guiding member being arranged downstream of the retaining member in a sheet conveyance direction, the downstream guiding member including a guide surface inclined at an angle relative to a top surface of the friction separation member toward the sheet feeding member; and
a sheet guiding member arranged upstream of the friction separation member in the sheet conveyance direction,
wherein
the sheet guiding member is between the bottom plate and the retaining member and not in contact with neither the bottom plate nor the retaining member,
a line that is connected between a first apex being an apex of a guide surface of the sheet guiding member and a second apex being an apex of the guide surface of the downstream guiding member is positioned closer to the sheet feeding member than a contact portion of the sheet feeding member and the friction separation member, and
the sheet guiding member is a different member from the bottom plate and the retaining member.

22. The image forming apparatus according to claim 21, wherein the retaining member is configured to translate towards the sheet feeding member independently of the sheet guiding member.

* * * * *